United States Patent [19]

Golobic et al.

[11] Patent Number: 4,519,715

[45] Date of Patent: May 28, 1985

[54] PROPELLER

[75] Inventors: Robert A. Golobic; Michael H. Scott, both of Colorado Springs, Colo.

[73] Assignee: Joy Manufacturing Company, Pittsburgh, Pa.

[21] Appl. No.: 552,857

[22] Filed: Nov. 17, 1983

Related U.S. Application Data

[63] Continuation of Ser. No. 326,084, Nov. 30, 1981, abandoned.

[51] Int. Cl.[3] ..... B01F 7/22

[52] U.S. Cl. ..... 366/343; 416/202

[58] Field of Search ..... 366/343, 330; 416/231 A, 235, 242, 243, 238, 223 R, DIG. 2, 202

[56] References Cited

U.S. PATENT DOCUMENTS

| | | | |
|---|---|---|---|
| 1,019,078 | 3/1912 | Olmsted | 416/243 X |
| 1,706,608 | 3/1929 | Holmes | 416/243 X |
| 3,014,534 | 12/1961 | Vartiainen | 416/238 |
| 4,135,858 | 1/1979 | Entat | 416/238 |
| 4,147,437 | 4/1979 | Jonqueres | 366/343 |

FOREIGN PATENT DOCUMENTS

| | | | |
|---|---|---|---|
| 555366 | 3/1957 | Belgium | 416/235 |

*Primary Examiner*—Robert W. Jenkins
*Attorney, Agent, or Firm*—Edward L. Levine

[57] ABSTRACT

Propellers including blades affixed to a hub which provide generally axial flow of a fluid medium through the blade area. The blades are formed from cylindrical segments and include a generally straight leading edge and a generally convex trailing edge.

10 Claims, 12 Drawing Figures

PROPELLER

This application is a continuation of application Ser. No. 326,084, filed 11/30/81, now abandoned.

FIELD OF THE INVENTION

This invention relates to propellers and propeller blades, and more particularly to an easily constructable propeller useful in systems for providing flow in a direction substantially parallel to the axis of rotation of the propeller, such as agitation processes within a containing vessel.

BACKGROUND OF THE INVENTION

Propellers are well known for many uses which provide, for given applications, preselected fluid flow and efficiency characteristics. In certain processes, particularly those operating upon liquids or suspensions within a containing vessel, such as mixing, conditioning, agitation and attrition scrubbing, it is beneficial to provide a flow pattern substantially parallel to the axis of rotation of the propeller and shaft, particularly in the local region of the propeller. Propellers are often difficult to manufacture, and many attempts have been made to improve propellers in terms of manufacturing techniques, material usage and operational power requirements.

For example, U.S. Pat. No. 745,853 discloses a propeller having blades with faces curved in a complex manner to impart to water within which it turns a motion parallel to the shaft axis. The blades are shaped as a true cycloidal curve wherein plural angles of lead of pitch vary as a function of distance from the propeller hub. For maximum strength, the blades are affixed to a hub at a 45° angle, and are thicker at the hub than at the outer ends. This configuration is said to minimize the presence of surfaces or parts which serve as a drag to impede motion of a vessel driven by the propeller, and may appear to be useful in a mixing environment. The blades, however, are difficult to manufacture as a result, among other considerations, of the complex cycloidal shape, and thus may not be efficiently suitable for use in processes taking place within a containing vessel.

Another teaching, U.S. Pat. No. 1,444,923, discloses a blade for a fan useful where strength characteristics in response to fluid induced forces is not as critical, such as in the movement of air. The blades, therefore, are formed of a composite material, hardened with a binder. The materials are initially molded into sections of hollow cylinders, or other regular shapes such as curved sheets, strips or hemispheres, and the blades are subsequently punched from the curved sections at an angle to the axis of the sections. The blades are mounted on a hub in a manner such that the central longitudinal dimension, or so called axis of the punched blade, extends radially from the hub. While blades so constructed may alleviate excessive labor and expense relative to other fabrication techniques, there is no indication that a propeller formed in this manner will provide a flow of air substantially parallel to the axis of hub rotation.

Another teaching, U.S. Pat. No. 4,147,437, discloses an impeller for imparting turbulent motion to a fluid medium within a containing vessel, and particularly shows blades useful in adjusting the degree of angular dispersion of the medium from the axis of impeller rotation. The impeller is said to be efficient in terms of power consumption. Trapezoidal sheets are curved, such as by cylindrical circular rolling, in a manner such that the central axis of the symmetrical trapezoidal sheet is at a preselected angle to the rollers and thus also to the surface of the curved sheet. Where the preselected angle is zero, it is stated that a conical flow pattern, from the impeller toward the vertical sides of the containing vessel, of approximately 45° is obtained. Where the preselected angle is positive as defined, approximately 20°, a cylindrical flow pattern, that is, flow parallel to the axis of rotation of the impeller, is obtained. Similar flow patterns are said to be obtained through compound, specifically angled and shaped blade surfaces and flaps. While desired flow patterns within containing vessels can be obtained, manufacturing of such impellers is relatively complex requiring, among other steps, fabrication of the trapezoidal sheet and rolling or pressing at a specific angle. The latter operations are made more difficult where thick blades are desired.

It is thus desirable to provide propellers and blades which are relatively simple to fabricate and which provide a fluid flow pattern generally parallel to the axis of rotation of the propeller. It is further desirable to provide such propellers which operate with low power consumption to achieve a desired fluid motion or degree of turbulence.

SUMMARY OF THE INVENTION

This disclosure provides propellers, and methods for making propellers, particularly useful as an impeller or often called agitator-propeller, for movement of a fluid medium in a generally liquid or suspended solid state within a containing vessel, also useful in many other applications. Propellers in accordance with the invention are very efficient in terms of drive power requirements, and impart flow to the fluid medium generally parallel to the axis of rotation of the propeller, particularly in the local region about the propeller. Such propellers can be fabricated with relative ease.

In one preferred form, propeller blades are made from a hollow cylinder, such as standard pipe of a desired grade and diameter. In one embodiment the planform of the blade is basically triangular, including a straight front leading edge, a straight side trailing edge generally perpendicular to the leading edge, and a concavo-convex rear trailing edge shaped in accordance with prescribed analytical relationships. Also provided is a concave attachment edge for attachment of the blade to a hub. The straight leading edge is cut along a line which is parallel to the longitudinal axis of the cylinder. The trailing edge generally tapers, such that the blade has a larger dimension at the root, adjacent the hub, and a smaller dimension at the tip. When attached to the hub, a lineal extension of the axis of the original cylinder from which the blade has been cut intersects the axis of the hub, or lineal extensions of the hub axis. Lineal extensions of the leading edge, which are parallel to the axis of the original cylinder, however, do not intersect the axis of the hub. The repose of the leading edge from a radius of the hub, that is, the spacing between a radius of the hub which is parallel to the leading edge, and the leading edge, is bounded by the prescribed analytical relations.

In a further preferred form, where R is the distance from the axis of the hub to the tip of the blades, it is also beneficial to maintain relationships such that the radial distance from the hub axis to the outer circumference of the hub is approximately R/4, the length of the side trailing edge is approximately R/4, the axial length of the hub is approximately R/4, and the distance from the leading edge of the hub to the tip of the blades where the trailing and side edges come together, measured along the hub axis, is R/2.

It has been found that blades of this type provide a substantial degree of fluid motion through the propeller region parallel to the axis of rotation, and propellers relatively light in weight which require a low energy input to generate a given thrust.

BRIEF DESCRIPTION OF THE DRAWINGS

The advantages, nature and additional features of the invention will become more apparent from the following description taken in connection with the accompanying drawings, in which.

DESCRIPTION OF THE PREFERRED EMBODIMENTS

Figure 1:
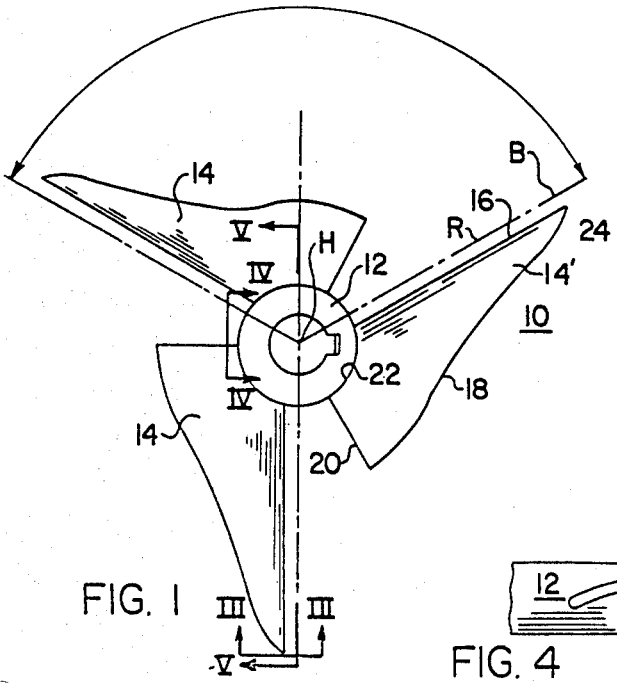
FIG. 1 is a top plan view of a propeller in accordance with the invention.

Referring now to FIG. 1 there is shown one preferred embodiment of a propeller 10 in accordance with the invention. The propeller includes a hub 12 and a plurality of blades 14 affixed thereto. During operation the propeller 10 rotates about a longitudinal hub axis H. The hub 12 is preferably cylindrical, and other configurations can also be utilized.

Each blade 14 is generally triangular in planform, and includes a substantially straight leading edge 16, a long trailing edge 18, and a short trailing edge 20. The long trailing edge 18 is concavo-convex, and the short trailing edge 20 is preferably straight and substantially perpendicular to the leading edge 16. In some instances a generally convex long trailing edge 18 is utilized. Each blade 14 also includes a concave attachment edge 22 matingly configured for attachment of the hub 12 at the region adjoining the leading 16 and short 20 trailing edges. The blades are thus configured and positioned to provide a generally larger surface at the root, adjacent the hub 12, which tapers to a smaller surface at the tip 24 of the blade 14. In preferred form, the straight leading edge 16 is parallel to and spaced from a radius R extending outwardly from the axis H in the same plane as the leading edge 16.

Figure 2:
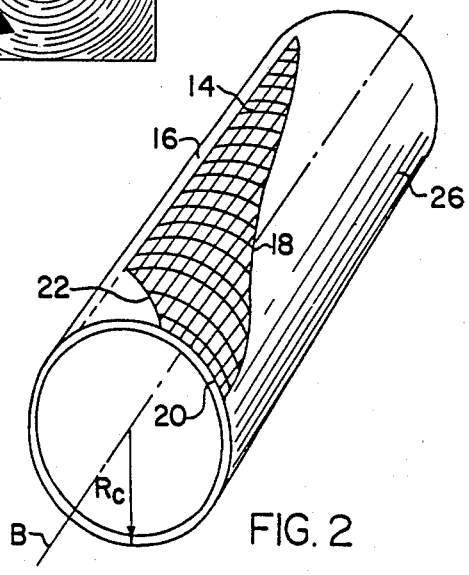
FIG. 2 is a prespective view of a propeller blade layout on a hollow right circular cylinder.

Each blade 14 is formed from a hollow cylinder 26 or a selected portion of a hollow cylinder, herein referred to as a cylindrical segment, as shown best in FIG. 2. The radius of the cylindrical segment from which the blade is cut is $R_c$. The blade cylinder or segment has a longitudinal axis B. The leading edge 18 is parallel to the axis B and the short trailing edge 20 is accordingly perpendicular thereto.

The trailing edge is prescribed generally in accordance with a unique set of analytical relationships which incorporate, in part, portions of well known thin airfoil theory and other propeller design relationships, discussed further hereinafter.

Figure 4:
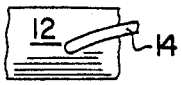
FIGS. 3, 4 and 5 are elevation views taken respectively at III—III, IV—IV and V—V of FIG. 1, with some features being deleted for clarity.
Figure 3:
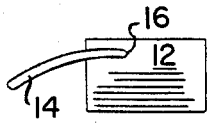
Figure 5:
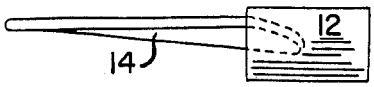

Upon attachment of the blades 14 to the hub 12, a lineal extension of the blade axis B intersects the axis H of the hub and propeller rotation, or a lineal extension thereof, and is perpendicular thereto. In FIG. 1, a top plan view of a propeller, the radial line R is the axis B of the original cylindrical segment from which the blade 14' has been cut. It will be recognized that intersection of these axes sets the shape of the attachment edge 22 and the angle of attachment of each blade 14 to the cylindrical hub 12, as shown in FIGS. 3, 4 and 5. The blades 14 can be attached to the hub 12 by welding or other well known means for attachment.

Although the radial line R and the axis B appear as the same line in FIG. 1, the plane of the Figure (the plane of the page) can be viewed as the plane of the straight leading edge 16, which is the uppermost elevation of the blade 14 as shown in FIG. 3. Thus, axis B is below the plane of the Figure, and R can be at any plane at or below the plane of the Figure. Where the line R, being a radius of the hub extending outwardly from the hub axis H, is in the plane of the Figure, the straight leading edge 16 is parallel to and spaced from the radius R.

Figure 6:
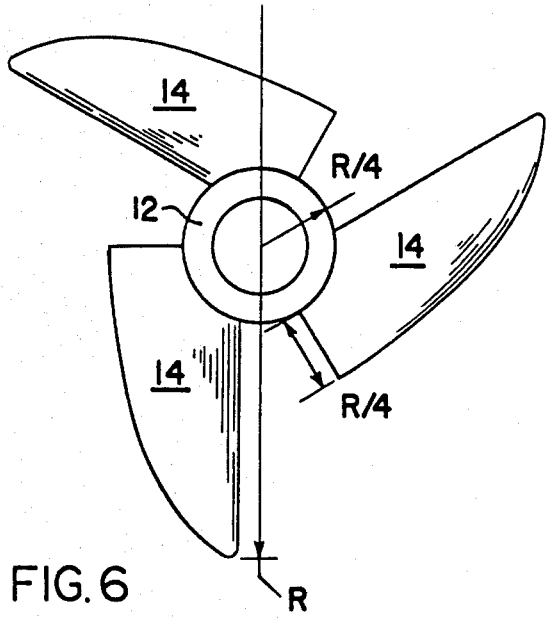
FIG. 6 is a top plan view of a propeller, similar to FIG. 1, showing preferred dimensional relationships.
Figure 7:
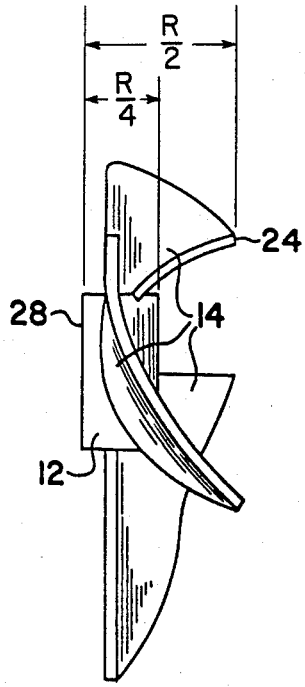
FIG. 7 is a side view of the propeller of FIG. 6.

In preferred form, the propeller is also constructed in accordance with the relationships shown in FIGS. 6 and 7. R, as discussed with respect to FIG. 1, is the radius of the propeller 10. The radius to the hub perimeter is approximately R/4, as is the length of the short trailing edge 20 and the longitudinal dimension or axial length of the hub 12. The distance from the leading surface 28 of the hub to the tip 24 of each blade 14 is approximately R/2.

In addition to the configuration and layout set forth above, a final propeller configuration is defined beginning with a fundamental set of well known equations based upon the theory developed by Glauert focusing on minimization of drag induced by pressure differentials associated with the generation of thrust. As is common in propeller design, a tip speed ratio, $\nu$, and the number of blades, N, is selected. Tip speed ratio is a commonly used parameter in rotor design, and is chosen to produce a maximum figure of merit. The figure of merit is the ratio of the thrust coefficient to the torque coefficient. For a common three blade propeller rotating in air, the tip speed ratio for a maximum figure of merit is about 0.17. For liquid and slurry applications, a value between 0.5 and 0.7 is typically chosen, depending upon the particular application. Agitator application, for example, practically lies in a range between the maximum figure of merit and 1. It is also preferred, particularly for agitator application, to select the number of blades, N, at 3 or 4. The planform associated with two blades is quite large, and five or six blades require narrow planforms and increased fabrication costs, although beneficial flow conditions can be achieved with other than 3 or 4 blades.

The well known hydrodynamic twist of a blade, $\phi$, is the angle between the flow velocity vector of the fluid medium within which a propeller is rotating and the plane of blade of rotation. The hydrodynamic angle of twist at the tip of the blade is defined as $\phi_t$. It is known that $$\phi_t = \text{Arctan } \nu/2, \tag{1}$$

and for each location along a blade radially outward from the axis of rotation H, $$\phi = \text{Arctan } \nu/2\epsilon, \tag{2}$$

where $\epsilon$ is a non-dimensional variable which is the ratio of the radial station of calculational interest, or selected radial location, divided by the propeller radius R; $\epsilon=1$ is the station at the tip of the blade and $\epsilon=0.5$ is the station midway between the blade tip and the axis of rotation.

Figure 8:
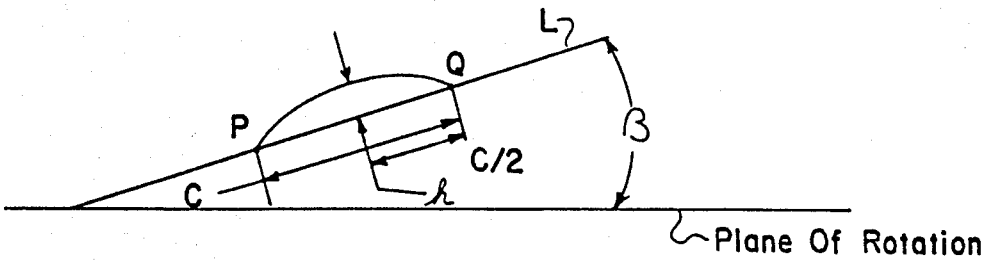
FIG. 8 is a developed view of a section of a propeller blade, particularly showing the chord line and the plane of propeller rotation.

With reference to FIG. 8, the following four relations are also well known in the art:

$$f = \frac{(1-\xi)N}{2\sqrt{2}\ \nu \cos \phi_t}, \tag{3}$$

$$F = \frac{2}{\pi} \text{ Arccos } (e^{-f}), \tag{4}$$

$$G = (\sqrt{2}\ \pi\xi\nu)(\sin \phi)(\cos \phi)F, \text{ and }, \tag{5}$$

$$\frac{c}{R} C_l = \frac{2G}{(\xi N \cos \phi)}, \tag{6}$$

where f, F and G are intermediate dependent variables in the analytical process, c is the chord length of a chord at a selected blade section, and c/R is accordingly the chord length divided by the propeller radius, and $C_l$ is the section lift coefficient for the selected blade section.

Figure 9:
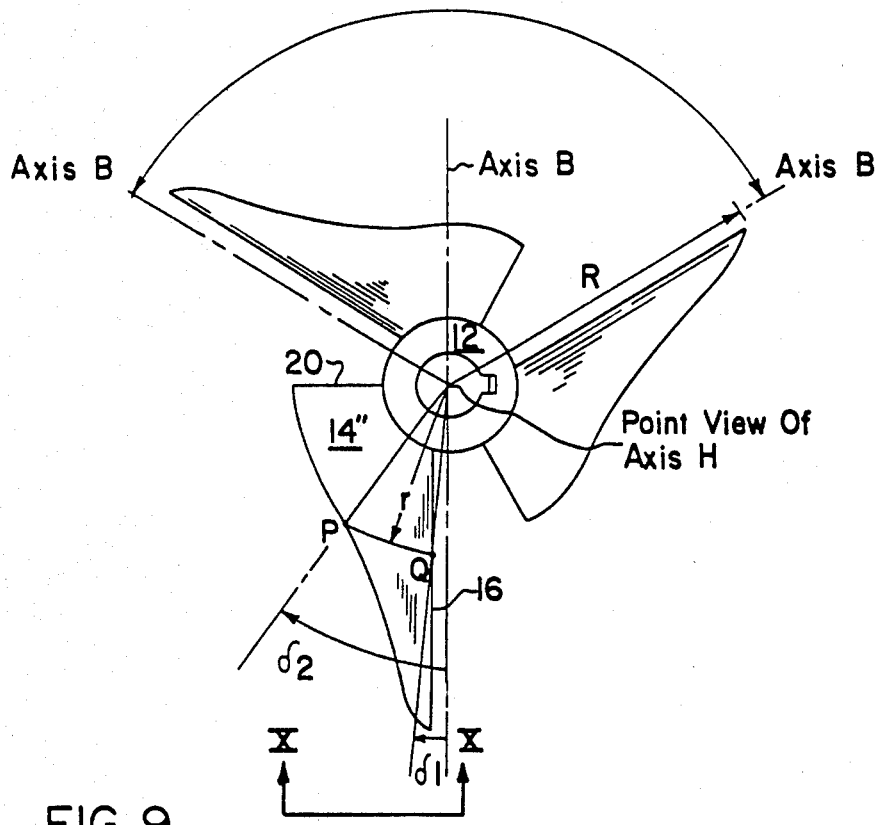
FIG. 9 is top plan view of a propeller, similar to FIG. 1, identifying nomenclature.

FIG. 8 shows the chord line of length c between blade end points P and Q on a chord line L. The chord line L as shown in FIG. 9 is curved, and its radius of curvature matches the radial station, r. In FIG. 8, the chord line, L, is shown in a developed view. The height of the circular arc at a given blade section, h, is at the midpoint of the chord, c/2.

Equation number (6) defines, analytically, the hydrodynamic constraint on the geometry of the propeller blades in accordance with thin airfoil theory. Additional background on propeller design using thin airfoil theory can be found in *The Elements of Airfoil and Airscrew Theory,* by H. Glauert, published by Macmillan, New York, in 1943. This theory was further refined by E. Eugene Larabee in "Practical Design of Minimum Induced Loss Propellers", SAE paper No. 790585, presented at the Business Aircraft Meeting and Exposition, Century II, Wichita, Kans., Apr. 3–6, 1979. Glauert's theory is centered on the concept of minimizing the drag induced by pressure differentials associated with the generation of thrust by a propeller. Analytically, a propeller must satisfy equation number (6) to have a minimum induced loss in accordance with the theory.

It has been found that when the above and the following constraints and relationships are adhered to, blades can be readily formed from cylindrical segments which blades will minimize induced loss, provide a substantial degree of flow of a fluid medium parallel to the axis of propeller rotation, and which concommitantly require less torque, and thus less input power to the propeller, than previously required for a given thrust.

As discussed above, the axis B of the cylinder from which the blade is cut is positioned to intersect, at right angles, the axis H of the hub. Slight variations from direct intersection of the axes are acceptable. A ratio defined as d is the length of the radius, $R_c$, of the cylinder from which the blade is formed, divided by the length of the radius of the propeller R. Thus, $$d = R_c/R. \tag{7}$$

It has been found that d must lie between 0.1 and 1. A small value of d, in the range of 0.1, results in excessive curvature of the blade cross-section which tends to deviate from thin airfoil characteristics and which detrimentally increases the likelihood of flow separation on the blade, loss of thrust and increased drag. The ratio d should be kept above 0.125 so as to avoid excessive curvature and the detrimental flow characteristics. A large value of d, in the range of 1.0, results in an insufficient geometric twist, $\beta$, over the entire blade. A value of d in the range of 0.5 is preferred. Ease of fabrication can be facilitated by utilization of a value close to 0.5 which corresponds, for example, to a standard pipe or tube size.

Once a value of d is selected, the following set of newly formulated equations, numbered 8 through 13, as well as equation number 6, must be simultaneously satisfied for each value of $\epsilon$.

$$\epsilon \sin \delta_1 = d \sin \Delta_1 \tag{8}$$

$$\epsilon \sin \delta_2 = d \sin \Delta_2 \tag{9}$$

$$\left(\frac{C}{R}\right) \cos \beta = \epsilon(\delta_2 - \delta_1) \tag{10}$$

$$\frac{h}{R} = d\left(1 - \cos\left(\frac{\Delta_2 - \Delta_1}{2}\right)\right) \tag{11}$$

$$\frac{C}{R} \sin \beta = d(\cos \Delta_1 - \cos \Delta_2) \tag{12}$$

$$C_l = 2\pi\left\{\beta - \phi + \text{ARCTAN}\left[2\left(\frac{h}{R}\right)\left(\frac{R}{C}\right)\right]\right\} \tag{13}$$

Figure 10:
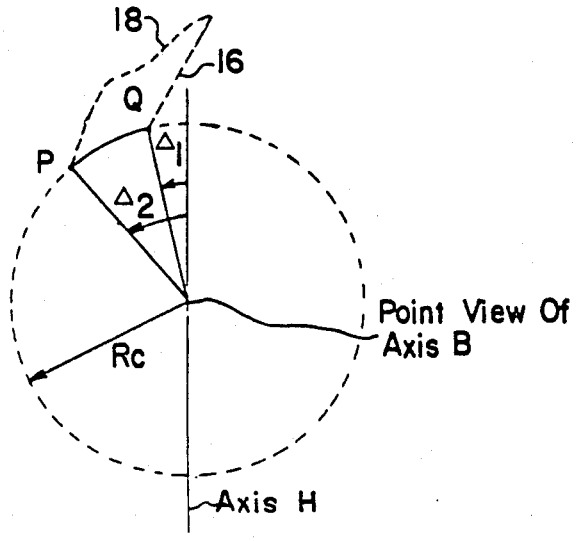
FIG. 10 is a side view of a cylinder from which a propeller blade in accordance with the invention is cut, taken at X—X of FIG. 9 with respect to a single blade 14"

Particular reference is made to FIGS. 8, 9 and 10 for an explanation of the nomenclature. In FIG. 9, $\sigma_1$, is the angle formed by a line parallel to the axis B of the cylindrical segment which axis B intersects the axis H of rotation, and another radial line from the axis H to a point on the leading edge at a radius r in the plane perpendicular to the axis H. Thus, $\sigma_1$, is defined at each value of $\epsilon$ or r, r being the positional equivalent of the non-dimensional ratio $\epsilon$. Also shown in FIG. 9, $\sigma_2$ is an angle, similar to $\sigma_1$, defining the angle to a point on the trailing edge, $\sigma_2$ being greater than $\sigma_1$.

$\beta$, FIG. 8, is the well known geometric angle of twist, which is, at each blade section, the angle between the chord line L and the plane of propeller rotation. $\beta$ is generally small at the blade tip, continuously increasing to a larger value at the hub.

As shown in FIG. 10, $\Delta_1$ is the angle formed by a line parallel to the hub axis H, which axis H intersects the blade axis B, and another radial line from the axis B to a point at the leading edge of a selected blade section. It is accordingly defined at each $\epsilon$ or r. The dotted lines representing the leading 16 and trailing 18 edges are shown merely for orientation. Correspondingly, $\Delta_2$ is an angle, similar to $\Delta_1$, to a point on the trailing edge 18. $\Delta_2$ is greater than $\Delta_1$.

With a straight leading edge, $\Delta_1$ is a preselected constant. It has been found that $\Delta_1$, as shown in FIG. 10, must be between 0° and 45° . A value of $\Delta_1$ less than 0 provides a blade which cannot simultaneously provide a sufficient section lift coefficient, $C_l$, and a curvature which does not violate thin airfoil theory. A large value for $\Delta_1$ in the range of 45°, also violates thin airfoil theory. A value of $\Delta_1$ between 5° and 10° is preferred. An additional constant, based upon thin airfoil theory, is that the quantity $\beta-\phi+\text{ARCTAN}\ [2(h/R)\ (R/c)]$ of equation (13) must be between 0 and 0.25.

It will now be recognized that there are seven equations, numbered (6) and (8) through (13), and seven unknowns, $\sigma_1$, $\sigma_2$, $\Delta_2$, $\beta$, c/R, h/R and $C_l$, which prescribed the geometry of the trailing edge. A sufficient quantity of calculations, for selected $\epsilon$ or r values, will prescribed the shape of the long trailing edge 18. The short trailing edge 20, is formed by cutting the blade cylinder at right angles to the leading edge. It has been found that the long trailing edge 18, in order to satisfy the relationships, will be concavo-convex in shape.

It will be recognized that a blade formed in accordance with the invention, from a cylindrical segment or otherwise, such as a casting, will perform best where the edges are appropriately radiused. The adjoining corners of the triangular planform can also be radiused or otherwise smoothed. Additionally, propellers in accordance with the invention are compatible with useage of chemical or abrasion resistant coatings, such as rubber based, urethane or other materials, and such coatings can beneficially increase operating efficiency.

A propeller in accordance with the invention is configured as follows:

Consider the case of a typical loading condition used in the design of a propeller. For example, choose the tip speed ratio $\nu=0.7$, and the number of blades, N=3. From equation (1), $\phi_t=19.3°$. Now select the radial location of interest, for example $\epsilon=0.75$. From equation (2), $\phi=25.0°$. Equations (3), (4) and (5) results in f=0.401, F=0.533, and G=0.476. Equation (6) results in c/R $C_l=0.467$. Now choose d=0.5 and $\Delta_1=5°$. Using the results of equation (6), and equations (8) through (13), the seven unknowns, $\sigma_1$, $\sigma_2$, $\Delta_2$, $\beta$, c/R, h/R and $C_l$ can be determined through iteration. Any standard iteration routine can be used. The results are $\sigma_1=3.3°$
$\sigma_2=30.5°$
$\Delta_2=49.7°$
$\beta=26.1°$
c/R=0.396°
h/R=0.0375°
$C_l=1.18°$ This procedure can now be repeated for various values of with $\nu$, N, d and $\sigma_1$ fixed. The lower bound of $\epsilon$ is limited to the one which corresponds to the value at which the trailing edges 18 and 20 converge as shown in FIG. 9. For this particular design the value of $\epsilon$ for this point is approximately 0.5.

Figure 12:
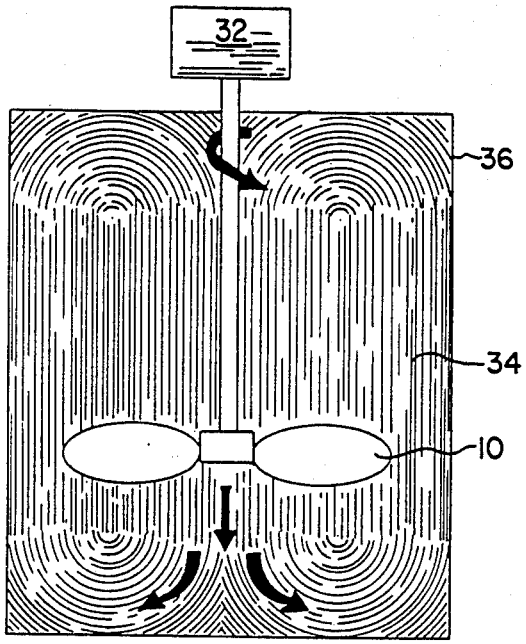
FIG. 12 is a schematic view of a fluid medium within a container driven by a propeller in accordance with the invention.
Figure 11:
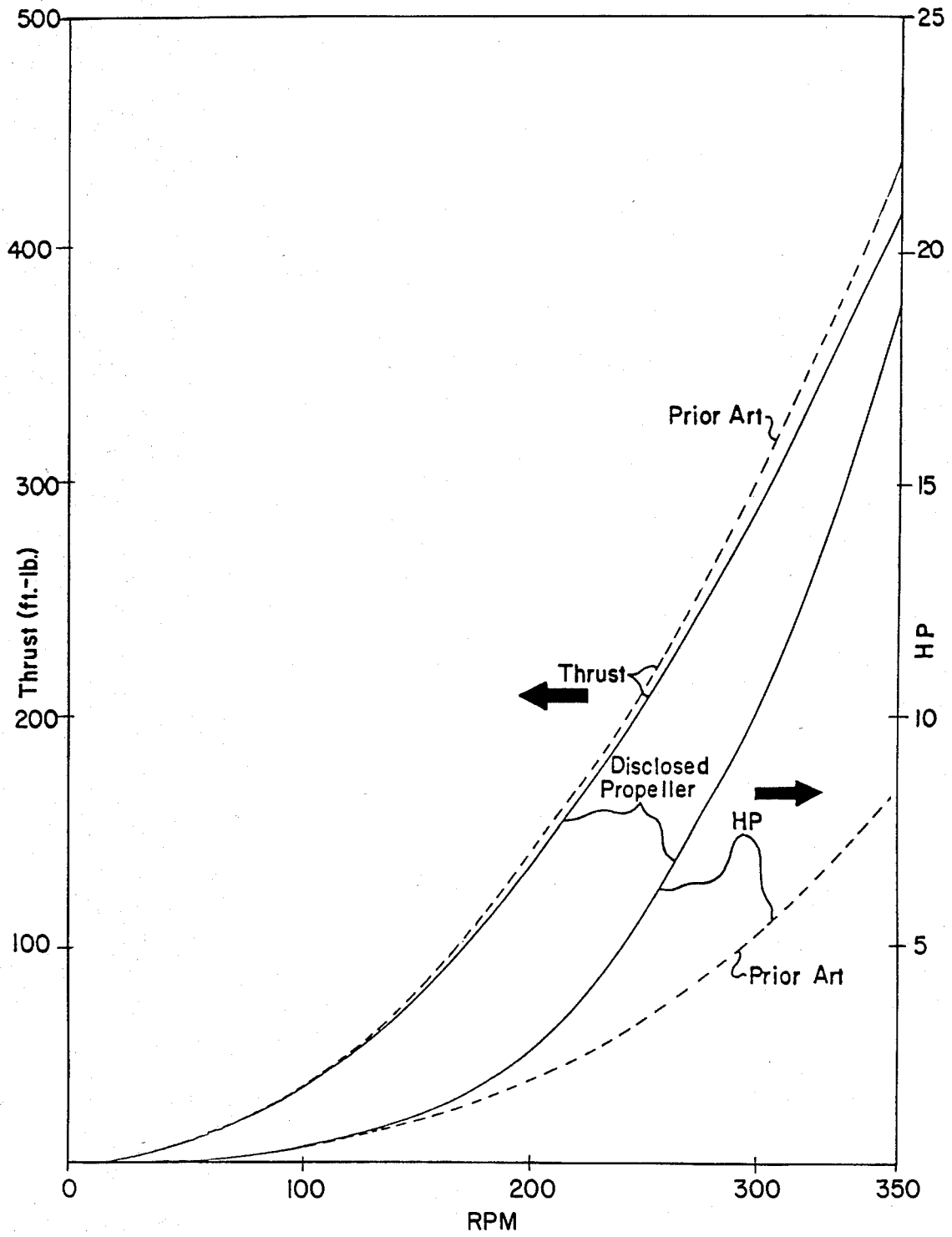
FIG. 11 is a graph of test data showing thrust, in foot pounds, and power, in horsepower (vertical axes), versus rotational velocity, Revolutions per minute (horizontal axis), for two propellers.

The starting results from a propeller 10 readily formed from a hollow cylinder in accordance with the disclosed relationships can be appreciated from a review of FIG. 11. The Figure presents test results for a twenty-six inch prior art metallic agitator propeller and a twenty-six inch metallic propeller in accordance with the invention. As readily apparent, similar thrust is achieved at a greatly reduced horsepower with utilization of a propeller as disclosed. It was also determined during testing that a substantial degree of flow parallel to the axis of rotation is achieved with the disclosed propeller, and greater mixing of fluid or other mediums is achieved. Additionally, the weight of the disclosed propeller is reduced compared to the prior art agitator-propeller. Generally, a weight reduction of greater than fifty percent can be acheived compared to prior propellers providing similar thrust. Balancing of the propeller is accordingly easier, minimizing vibration and bearing wear. The axial flow pattern is shown schematically in FIG. 12 wherein a propeller 10 is mounted on a rotatable shaft 30 driven by a motor 32. A fluid medium 34, for example, a slurry , experiences an axial flow pattern through the local region of the propeller 10, and establishes within a container 36 a generally vertical flow path.

The generally vertical flow pattern can beneficially be applied to systems, such as attrition scrubbing, wherein two opposing propellers, axially aligned, direct fluid streams against one another. Many other applications and similar blade and propeller configurations are possible within the scope of the disclosure. It is thus intended that information contained in the foregoing description and drawings be taken as illustrative, and not in a limiting sense.

I claim:

1. A propeller comprising a hub rotatable about a hub axis H and a plurality of blades affixed to said hub, each said blade including a straight leading edge and a concavo-convex trailing edge, each said blade being a portion of a cylindrical segment having an axis B, said axis B intersecting said axis H, said straight leading edge and lineal extensions thereof being parallel to said axis B and non-intersecting with said hub axis H and being spaced, with respect to the direction of rotation, behind a radius extending outwardly from said axis H which radius is parallel to and in the same plane as said straight leading edge.

2. The propeller of claim 1 wherein each said blade has a generally triangular planform including said straight leading edge and said concavo-convex trailing edge, and another trailing edge which is substantially perpendicular to said leading edge.

3. The propeller of claim 2 further comprising a concave attachment edge adjoining said leading and another trailing edge.

4. The propeller of claim 3 wherein said hub is generally cylindrical and the radius of said propeller is R, the distance from said axis H to the outer circumference of said hub is approximately R/4, the length of said another trailing edge is approximately R/4, and the distance along said axis H from the leading edge of said hub to the tip of said blades whereat said trailing edges adjoin is approximately R/2.

5. A propeller comprising a generally cylindrical hub rotatable about a hub axis H and a plurality of blades affixed to said hub, each said blade including a straight leading edge, and a concavo-convex trailing edge, each said blade being a portion of a cylindrical segment having an axis B positioned to intersect said axis H, said straight leading edge and lineal extensions thereof being parallel to said axis B and parallel to and spaced, with respect to the direction of rotation, behind a lineal extension of a radius of said hub extending from said axis H in the same plane as said leading edge.

6. The propeller of claim 5 wherein each said blade has a generally triangular planform including said straight leading edge and said concavo-convex trailing edge, and another trailing edge which is substantially perpendicular to said leading edge.

7. The propeller of claim 6 further comprising a concave attachment edge adjoining said leading and another trailing edge.

8. The propeller of claim 7 wherein said hub is generally cylindrical and the radius of said propeller is R, the distance from said axis H to the outer circumference of said hub is approximately R/4, the length of said another trailing edge is approximately R/4, and the distance along said axis H from the leading edge of said hub to the tip of said blades whereat said trailing edges adjoin is approximately R/2.

9. A propeller comprising a hub rotatable about a hub axis H and a plurality of blades affixed to said hub, said blades each having a generally triangular planform including a straight front leading edge, and a generally convex rear trailing edge, each said blade also having a concave attachment edge adjoining said leading and side trailing edges, each said blade generally tapering from a larger surface adjacent said hub to a smaller surface at its tip whereat said leading and trailing edges adjoin one another, each said blade being a portion of a cylindrical segment having an axis B, each said blade being affixed to said hub in a manner such that a lineal extension of said axis B intersects one of said axis H and lineal extensions thereof, and wherein said leading edge of each said blade and lineal extensions thereof are parallel to said axis B and non-intersecting with said axis H and lineal extensions thereof and wherein, with respect to the direction of rotation, said leading edge is positioned behind a radius of said hub extending from said axis H parallel to and in the same plane as said straight leading edge.

10. A method of making a propeller comprising:

removing from a tubular cylinder having an axis B a section having a straight leading edge parallel to said axis B, a straight trailing edge substantially perpendicular to said leading edge, and a concavo-convex trailing edge; and affixing said blade to a generally cylindrical hub having an axis H in a manner such that said axis B intersects said axis H and such that said straight leading edge and lineal extensions thereof are non-intersecting with said axis H and parallel to and, with respect to the direction of rotation, spaced behind, a radius of said hub extending from said axis H in the same plane as said leading edge.

* * * * *